US011217089B2

(12) United States Patent
Suzuki

(10) Patent No.: US 11,217,089 B2
(45) Date of Patent: Jan. 4, 2022

(54) VEHICLE CONTROL DEVICE, VEHICLE CONTROL METHOD AND PROGRAM

(71) Applicant: TOYOTA JIDOSHA KABUSHIKI KAISHA, Toyota (JP)

(72) Inventor: Koichi Suzuki, Miyoshi (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 121 days.

(21) Appl. No.: 16/680,670

(22) Filed: Nov. 12, 2019

(65) Prior Publication Data

US 2020/0202704 A1 Jun. 25, 2020

(30) Foreign Application Priority Data

Dec. 21, 2018 (JP) ..... JP2018-239478

(51) Int. Cl.
*G08G 1/01* (2006.01)
*G08G 1/00* (2006.01)
*G08G 1/052* (2006.01)

(52) U.S. Cl.
CPC ..... *G08G 1/0112* (2013.01); *G08G 1/0125* (2013.01); *G08G 1/052* (2013.01); *G08G 1/20* (2013.01)

(58) Field of Classification Search
CPC ..... G08G 1/0112; G08G 1/20; G08G 1/052; G08G 1/0125; G08G 1/0133; B60W 50/00; B60W 2050/008; H04W 4/46
USPC ..... 340/435, 436; 701/116, 117, 118, 119
See application file for complete search history.

(56) References Cited

U.S. PATENT DOCUMENTS 10,520,952 B1 * 12/2019 Luckevich ..... B60W 10/18
2010/0256852 A1 * 10/2010 Mudalige ..... G08G 1/22 701/24
2013/0079953 A1 * 3/2013 Kumabe ..... G08G 1/22 701/2
2016/0272199 A1 * 9/2016 Kawahara ..... B60W 30/08

FOREIGN PATENT DOCUMENTS

JP 2003-272095 A 9/2003

* cited by examiner

*Primary Examiner* — Emily C Terrell
(74) *Attorney, Agent, or Firm* — Oblon, McClelland, Maier & Neustadt, L.L.P.

(57) ABSTRACT

When a vehicle passes through a predetermined spot, a vehicle control device sends a transmission signal including a vehicle number counter set to an initial value in a rearward direction of the vehicle. When the transmission signal is received through the inter-vehicle communication module from a vehicle that leads the own vehicle, the vehicle control device sets the vehicle number counter included in the transmission signal, to an updated value resulting from increasing the vehicle number counter by a predetermined value, and sends a transmission signal including the vehicle number counter set to the updated value in the rearward direction of the vehicle. The vehicle control device sends the vehicle number counter set to the initial value or the updated value, to a center server, if it is determined that there is no vehicle that follows the own vehicle at a relatively short inter-vehicle distance.

8 Claims, 5 Drawing Sheets

VEHICLE CONTROL DEVICE, VEHICLE CONTROL METHOD AND PROGRAM

INCORPORATION BY REFERENCE

The disclosure of Japanese Patent Application No. 2018-239478 filed on Dec. 21, 2018 including the specification, drawings and abstract is incorporated herein by reference in its entirety.

BACKGROUND

1. Technical Field

The disclosure relates to a vehicle control device and the like.

2. Description of Related Art

Conventionally, there has been disclosed a technology of serially sending a signal from a leading vehicle to a following vehicle by inter-vehicle communication in a bucket-brigade manner, counting the number of vehicles of a vehicle group that travels so as to be lined at relatively short inter-vehicle distances, and determining occurrence of congestion in the case where the number of the vehicles is equal to or more than a specified number (see Japanese Patent Application Publication No. 2003-272095 (JP 2003-272095 A), for example).

SUMMARY

However, for example, the vehicle group in the congestion state can be temporarily divided into a front vehicle group and a rear vehicle group. In this case, when the interval between the front vehicle group and the rear vehicle group temporarily increases to a degree at which the inter-vehicle communication cannot be performed, there is a possibility that the number of the vehicles of each of the vehicle groups does not reach a vehicle number at which the determination of the congestion is made and the occurrence of the congestion cannot be appropriately determined even when the congestion actually has occurred.

Hence, in view of the above problem, the disclosure has an object to provide a vehicle control device and the like that allow an external device to more appropriately determine the occurrence of the congestion.

For achieving the above object, in an embodiment of the disclosure, there is provided a vehicle control device that is mounted on a vehicle, the vehicle control device being capable of communicating with a predetermined external device, the vehicle control device including a control unit that controls a first communication unit and a second communication unit, the first communication unit being capable of communicating with a following vehicle that is positioned at equal to or shorter than a predetermined first distance rearward of the vehicle, the second communication unit being capable of communicating with a leading vehicle that is positioned at equal to or shorter than a predetermined second distance forward of the vehicle, in which:

when the vehicle passes through a predetermined position, the control unit sends a signal from the first communication unit in a rearward direction of the vehicle, the signal including vehicle number information set to a predetermined initial value;

when the control unit receives the signal including the vehicle number information through the second communication unit from the leading vehicle that is positioned forward of the vehicle, the control unit sets the vehicle number information included in the signal, to a new value resulting from increasing or decreasing the vehicle number information by a predetermined value, and sends a signal from the first communication unit in the rearward direction of the vehicle, the signal including the vehicle number information set to the new value; and when the vehicle passes through the predetermined position and the control unit determines that there is no following vehicle that is positioned rearward of the vehicle, the control unit sends the vehicle number information set to the initial value, to the external device, and when the control unit receives the signal including the vehicle number information through the second communication unit from the leading vehicle that is positioned forward of the vehicle and the control unit determines that there is no following vehicle that is positioned rearward of the vehicle, the control unit sends the vehicle number information set to the new value, to the external device.

With the embodiment, when the head vehicle of a certain vehicle group passes through the predetermined position, the vehicle control device of the head vehicle can send the signal including the vehicle number information set to the initial value, to the following vehicle. Further, by setting the first distance and the second distance to relatively short distances, in response to the signal sent from the head vehicle, the vehicle control device of a following vehicle that is performing follow-up traveling at a relatively short inter-vehicle distance can transmit the signal including the vehicle number information, to the last vehicle, while updating the vehicle number information. Then, the vehicle control device of the last following vehicle determines that there is no following vehicle, and thereby, can send vehicle number information corresponding to the number of the vehicles of the vehicle group, to the external device. Further, when a vehicle of a vehicle group that is traveling at relatively long inter-vehicle distances or a vehicle that is performing solo traveling passes through the predetermined position, the vehicle control device of the vehicle determines that there is no following vehicle, and thereby, can send the vehicle number information with the initial value indicating that the vehicle is a vehicle of the vehicle group that is traveling at relatively long inter-vehicle distances or that the vehicle is performing the solo traveling, to the external device. Therefore, the external device can grasp how many vehicles pass through the predetermined position so as to be lined at relatively short inter-vehicle distances, based on the vehicle number information sent from the vehicle control device. On this occasion, for example, even when the vehicle group is temporarily divided into two small vehicle groups so that the external device receives two pieces of vehicle number information about the leading vehicle group and the following vehicle group, the external device can regard the two vehicle groups as a single vehicle group, by comparing the receiving timings, and can determine occurrence of congestion. Accordingly, the vehicle control device allows the external device to more appropriately determine the occurrence of the congestion.

In the above-described embodiment, when the control unit receives the signal including the vehicle number information through the second communication unit from the leading vehicle that is positioned forward of the vehicle, the control unit may send an answer signal from the second communication unit in a forward direction of the vehicle, the answer signal indicating that the control unit has received the signal including the vehicle number information, and when the control unit sends the signal including the vehicle number information set to the initial value or the new value from the first communication unit in the rearward direction of the vehicle and the control unit does not receive the answer signal from the following vehicle that is positioned rearward of the vehicle, the control unit may determine that there is no following vehicle that is positioned rearward of the vehicle.

With the embodiment, the vehicle control device, specifically, can determine that there is no following vehicle, in the case where the vehicle control device sends the signal including the vehicle number information in the rearward direction of the own vehicle but no following vehicle sends back the answer signal.

In the above-described embodiment, when the vehicle passes through the predetermined position, the control unit may send a signal from the first communication unit in the rearward direction of the vehicle, the signal including the vehicle number information set to the initial value and vehicle speed information about the vehicle, when the control unit receives a signal through the second communication unit from the leading vehicle that is positioned forward of the vehicle, the signal including the vehicle number information and vehicle speed information about one or a plurality of different vehicles that is lined forward of the vehicle and that includes the leading vehicle, the control unit may set the vehicle number information included in the signal, to the new value, and may send a signal from the first communication unit in the rearward direction of the vehicle, the signal including the vehicle number information set to the new value and vehicle speed information about the vehicle and the different vehicles, and when the vehicle passes through the predetermined position and the control unit determines that there is no following vehicle that is positioned rearward of the vehicle, the control unit may send the vehicle number information set to the initial value and the vehicle speed information about the vehicle, to the external device, and when the control unit receives the signal including the vehicle number information and the vehicle speed information about the different vehicles through the second communication unit from the leading vehicle that is positioned forward of the vehicle and the control unit determines that there is no following vehicle that is positioned rearward of the vehicle, the control unit may send the vehicle number information set to the new value and the vehicle speed information about the vehicle and the different vehicles, to the external device.

With the embodiment, together with the vehicle number information, the vehicle control device of the last following vehicle of the vehicle group can send the vehicle speed information about the vehicles constituting the vehicle group, that is, the vehicle speed information about the own vehicle and all leading vehicles, to the external device. The same goes for the vehicle control device of the vehicle of the vehicle group that is traveling at relatively long inter-vehicle distances or the vehicle that is performing the solo traveling. Accordingly, in consideration of the vehicle speed information about the vehicles that pass through the predetermined position, the external device can more appropriately determine the situation of the occurrence of the congestion, and the like.

In the above-described embodiment, when the vehicle passes through the predetermined position, the control unit may send a signal from the first communication unit in the rearward direction of the vehicle, the signal including the vehicle number information set to the initial value and destination information about the vehicle, when the control unit receives a signal through the second communication unit from the leading vehicle that is positioned forward of the vehicle, the signal including the vehicle number information and destination information about one or a plurality of different vehicles that is lined forward of the vehicle and that includes the leading vehicle, the control unit may set the vehicle number information included in the signal, to the new value, and may send a signal from the first communication unit in the rearward direction of the vehicle, the signal including the vehicle number information set to the new value and destination information about the vehicle and the different vehicles, and when the vehicle passes through the predetermined position and the control unit determines that there is no following vehicle that is positioned rearward of the vehicle, the control unit may send the vehicle number information set to the initial value and the destination information about the vehicle, to the external device, and when the control unit may receive the signal including the vehicle number information and the destination information about the different vehicles through the second communication unit from the leading vehicle that is positioned forward of the vehicle and the control unit may determine that there is no following vehicle that is positioned rearward of the vehicle, the control unit may send the vehicle number information set to the new value and the destination information about the vehicle and the different vehicles, to the external device.

With the embodiment, together with the vehicle number information, the vehicle control device of the last following vehicle of the vehicle group can send the destination information about the vehicles constituting the vehicle group, that is, the destination information about the own vehicle and all leading vehicles, to the external device. The same goes for the vehicle control device of the vehicle of the vehicle group that is traveling at relatively long inter-vehicle distances or the vehicle that is performing the solo traveling. Accordingly, for example, from the destination information about the vehicles that pass through the predetermined position, the external device can predict future traffic states at other predetermined positions.

Other embodiments of the disclosure can be realized as a vehicle control method and a program.

With the above-described embodiments, it is possible to provide the vehicle control device and the like that allow the external device to more appropriately determine the occurrence of the congestion.

BRIEF DESCRIPTION OF THE DRAWINGS

Features, advantages, and technical and industrial significance of exemplary embodiments of the disclosure will be described below with reference to the accompanying drawings, in which like numerals denote like elements, and wherein.

DETAILED DESCRIPTION OF EMBODIMENTS

Hereinafter, an embodiment of the disclosure will be described with reference to the drawings.

Outline of Traffic State Information Collection System

Figure 1:
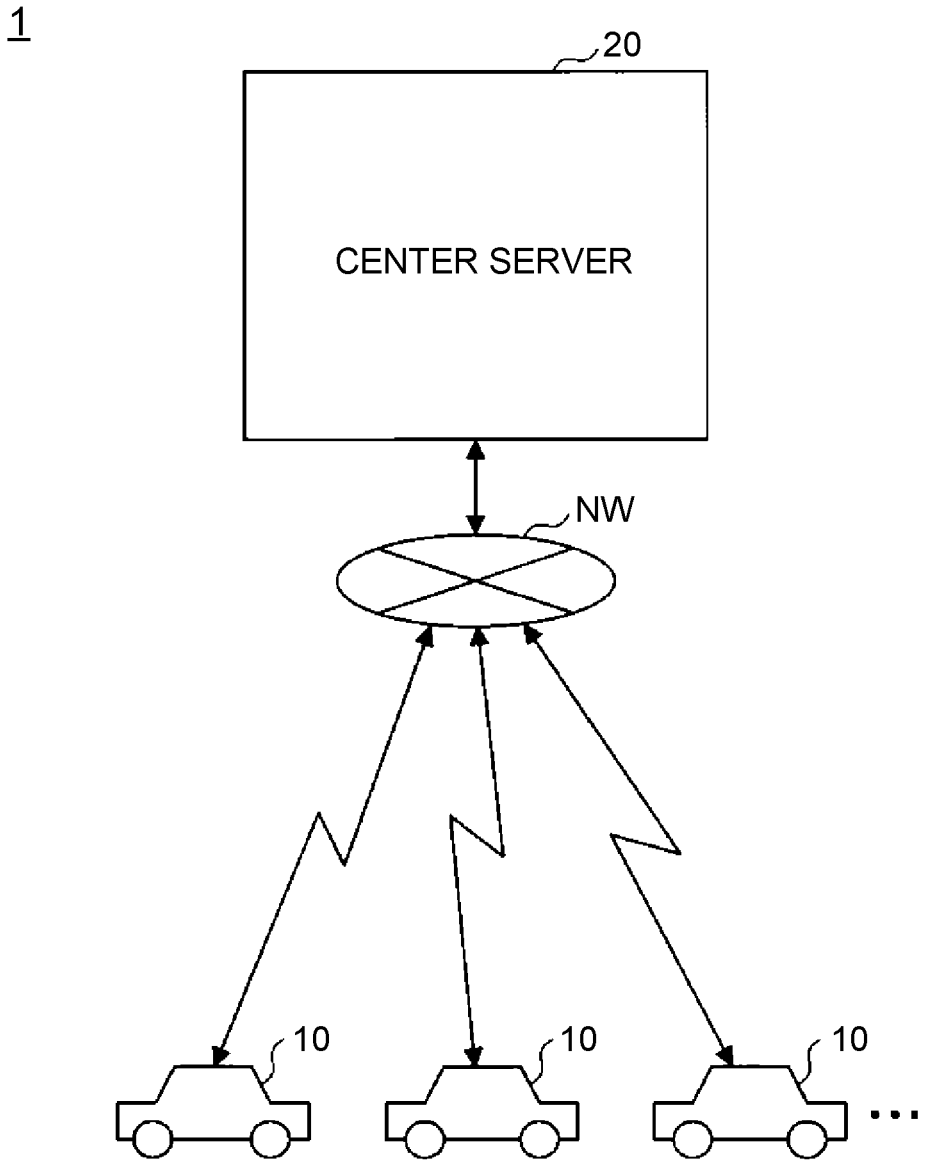
FIG. 1 is a schematic diagram showing an exemplary configuration of a traffic state information collection system.

First, an outline of a traffic state information collection system 1 according to the embodiment will be described with reference to FIG. 1.

The traffic state information collection system 1 includes a plurality of vehicles 10 and a center server 20.

In the traffic state information collection system 1, the center server 20 collects pieces of traffic state-related information (hereinafter, referred to as "traffic state information") that are acquired by the vehicles 10. For example, as described later, the traffic state information includes information (hereinafter, referred to as "vehicle number information") relevant to the number of the vehicles 10 constituting a vehicle group that is traveling so as to be lined at relatively short inter-vehicle distances in a front-rear direction, at one or a plurality of target spots that is previously specified, information (hereinafter, referred to as "vehicle speed information") relevant to the speed of the vehicle 10 included in the vehicle group, and information (hereinafter, "destination information") relevant to the destination of the vehicle 10 included in the vehicle group. Here, the target spot may be arbitrarily set, and for example, may be a spot where congestion easily occurs, as exemplified by a sag part and a joint part of an expressway. The target spot may be set by the center server 20, and may be delivered to each of the vehicles 10, through a communication network NW.

For example, the vehicle 10 is communicably connected with the center server 20, through the communication network NW that can include a mobile communication network using base stations as terminals, a satellite communication network using overhead communication satellites, and the internet network. At the target spot, the vehicle 10 uploads (sends) the traffic state information to the center server 20. Details of an acquisition method for the traffic state information will be described later.

The center server 20 (an exemplary external device) is communicably connected with each of the vehicles 10, through the communication network NW. The center server 20 receives the traffic state information at the target spot that is sent from the vehicle 10. Then, based on the received traffic state information, the center server 20 grasps the traffic state at the target spot, and predicts a future traffic state at another target spot. The center server 20 may deliver a grasp result of the traffic state at the target spot, a prediction result of the future traffic state at the target spot, and the like, to some or all of the vehicles 10.

Configuration of Traffic State Information Collection System

Next, a configuration of the traffic state information collection system 1 will be described with reference to FIG. 2 (FIG. 2A and FIG. 2B), in addition to FIG. 1.

Figure 2A:
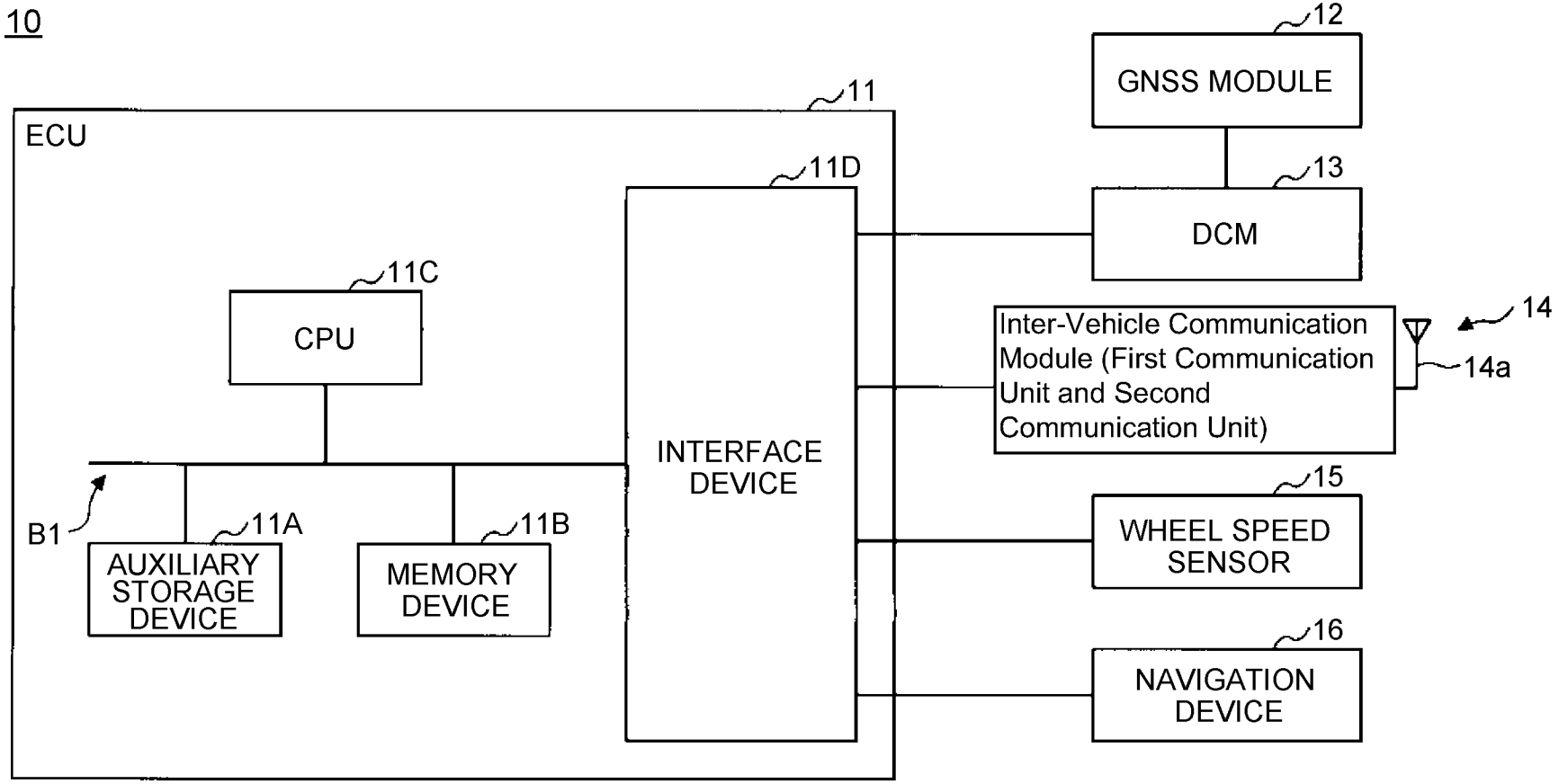
FIG. 2A is a diagram showing an exemplary configuration of a vehicle.
Figure 2B:
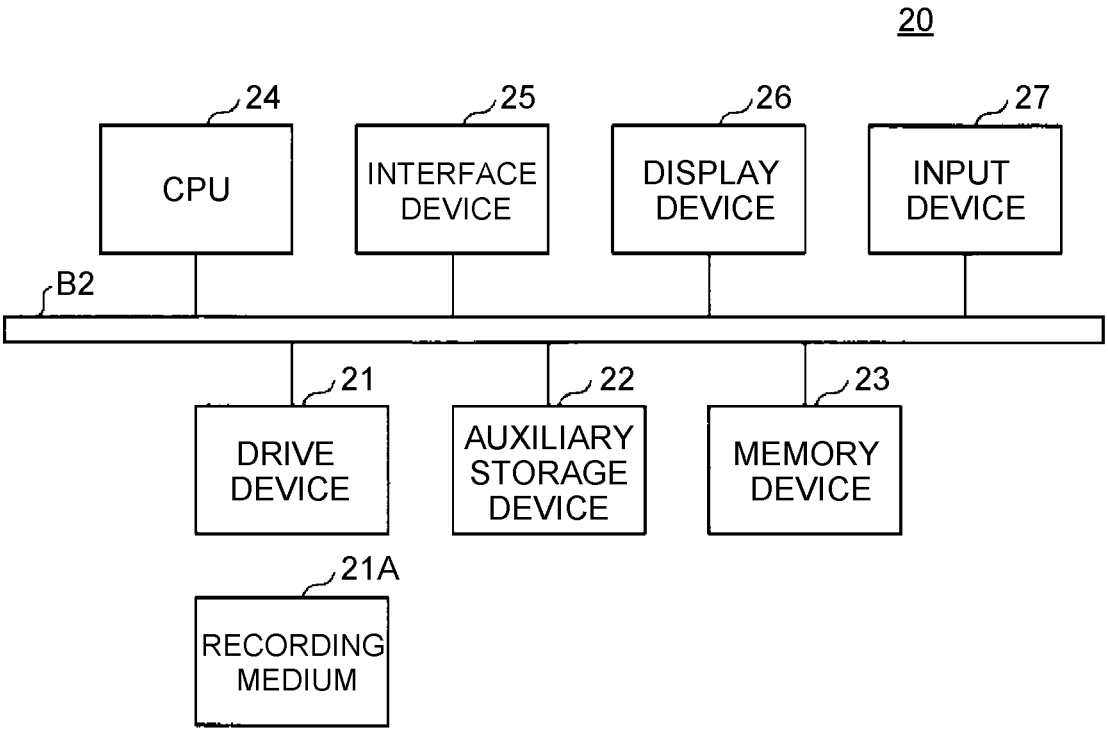
FIG. 2B is a diagram showing an exemplary configuration of a center server.

FIG. 2 are diagrams showing an exemplary configuration of the traffic state information collection system 1. Specifically, FIG. 2A is a diagram showing an exemplary configuration of the vehicle 10, and FIG. 2B is a diagram showing an exemplary configuration of the center server 20.

Configuration of Vehicle

As shown in FIG. 2A, the vehicle 10 includes an ECU 11, a global navigation satellite system (GNSS) module 12, a data communication module (DCM) 13, an inter-vehicle communication module 14, a wheel speed sensor 15, and a navigation device 16.

The ECU 11 (an exemplary vehicle control device) is an electronic control unit that performs various controls for the vehicle 10. Functions of the ECU 11 may be realized by arbitrary hardware or a combination of hardware and software. For example, the ECU 11 may be constituted mainly by a microcomputer including an auxiliary storage device 11A, a memory device 11B, a central processing unit (CPU) 11C, an interface device 11D, and the like, which are connected with each other by a bus B1.

For example, programs for realizing various functions of the ECU 11 are provided by a dedicated tool that is connected through a detachable cable to a connector (for example, Data Link Coupler (DLC)) for a predetermined external connection that is joined to an in-vehicle network such as a controller area network (CAN) of the vehicle 10. In response to a predetermined operation of the dedicated tool, the programs are installed in the auxiliary storage device 11A of the ECU 11, from the dedicated tool, through the cable, the connector and the in-vehicle network. Further, the programs may be downloaded from another computer (for example, the center server 20) through the communication network NW, and may be installed in the auxiliary storage device 11A.

The auxiliary storage device 11A, which is a non-volatile storage, holds the installed programs, and holds necessary files, necessary data and the like. Examples of the auxiliary storage device 11A include a hard disk drive (HDD) and a flash memory.

When an activation instruction for a program is given, the memory device 11B reads the program from the auxiliary storage device 11A, and holds the program.

The CPU 11C executes the program held in the memory device 11B, and realizes various functions of the ECU 11 in accordance with the program.

For example, the interface device 11D is used as an interface for connecting the ECU 11 with the in-vehicle network or connecting the ECU 11 with various sensors, various actuators and the like on a one-to-one basis. The interface device 11D may include a plurality of different kinds of interface devices, depending on targets to be connected.

For example, the ECU 11 controls the inter-vehicle communication module 14, and performs inter-vehicle communication with a different vehicle 10 that leads the vehicle 10 forward of the vehicle 10 or a different vehicle 10 that follows the vehicle 10 rearward of the vehicle 10, through the inter-vehicle communication module 14.

Further, for example, the ECU 11 controls the DCM 13, and communicates with the center server 20 through the communication network NW.

The GNSS module 12 measures the position of the vehicle 10 (the own vehicle) on which the GNSS module 12 is mounted, by receiving satellite signals that are sent from three or more, preferably, four or more satellites over the vehicle 10. For example, positioning information of the GNSS module 12, that is, position information about the vehicle 10 is taken in the ECU 11, through the DCM 13, the in-vehicle network or the like.

The DCM 13, which is connected with the communication network NW in the exterior of the vehicle 10, is a communication device for performing communication with an external device including the center server 20 through the communication network NW. The DCM 13 sends various signals (for example, information signals and control signals) to the center server 20, and receives various signals from the center server 20. Further, the DCM 13 is communicably connected with the ECU 11 through a one-to-one communication line or an in-vehicle network such as a CAN. In response to a request from the ECU 11, the DCM 13 sends various signals to the exterior of the vehicle 10 (the own vehicle), or outputs signals received from the exterior of the vehicle 10, to the ECU 11.

The inter-vehicle communication module 14 (an exemplary first communication unit and an exemplary second communication unit) is a known communication device for mutually performing wireless communication with a plurality of vehicles 10 using an electric wave in a radio frequency (RF) band (for example, a 700 MHz band or a 5.8 GHz band). The inter-vehicle communication module 14 may use an electric wave in a millimeter wave band (for example, a 60 GHz band) or a quasi-millimeter wave band (for example, a 24 GHz band). The inter-vehicle communication module 14 includes a directional antenna 14*a*.

The directional antenna 14*a* can emit the electric wave, such that the electric wave intensity in a particular direction as viewed from the vehicle 10, specifically, the electric wave intensity in a forward direction or rearward direction of the vehicle 10 is high and the electric wave intensity in the other directions is very low. Similarly, the directional antenna 14*a* may receive the electric wave from the exterior, such that the receiving sensitivity in a particular direction as viewed from the vehicle 10, specifically, the receiving sensitivity in the forward direction or rearward direction of the vehicle 10 is very high and the receiving sensitivity in the other directions is very low. Thereby, under control by the ECU 11, the inter-vehicle communication module 14 can establish the inter-vehicle communication only with the different vehicle 10 that leads the vehicle 10 forward of the vehicle 10 or the different vehicle 10 that follows the vehicle 10 rearward of the vehicle 10. Further, the directional antenna 14*a* adjusts the electric wave intensity, such that the electric wave reaches only in a range of equal to or shorter than a predetermined distance (hereinafter, referred to as a "communicable distance") in the forward or rearward direction of the vehicle 10, as an electric wave that is receivable for the inter-vehicle communication module 14 of the different vehicle 10. Here, the communicable distance may be previously specified as a value corresponding to the upper limit of the inter-vehicle distance between vehicles 10 in a situation where vehicle 10 are traveling on a road in a relatively congested traffic state, and may be about 10 meters, for example. Thereby, under control by the ECU 11, the inter-vehicle communication module 14 can establish the communication between vehicles 10 that are lined in the front-rear direction, only in the case where the inter-vehicle distance between the vehicles 10 is relatively short.

The communicable distance (an exemplary second distance) in the forward direction of the vehicle 10 may be the same as the communicable distance (an exemplary first distance) in the rearward direction of the vehicle 10, or may be different from the communicable distance in the rearward direction of the vehicle 10. Further, the directional antenna 14*a* may include a directional antenna for the communication with the different vehicle 10 that leads the vehicle 10 forward of the vehicle 10 and a directional antenna for the communication with the different vehicle 10 that follows the vehicle 10 rearward of the vehicle 10. Similarly, the inter-vehicle communication module 14 may include an inter-vehicle communication module (an exemplary second communication unit) for the communication with the different vehicle 10 that leads the vehicle 10 forward of the vehicle 10 and an inter-vehicle communication module (an exemplary first communication unit) for the communication with the different vehicle 10 that follows the vehicle 10 rearward of the vehicle 10.

The wheel speed sensor 15 is a known detector that detects the speed of each wheel of the vehicle 10. The wheel speed sensor 15 outputs detection information (hereinafter, referred to as "wheel speed information") corresponding to the speed of each wheel, and the wheel speed information is taken in the ECU 11, through a one-to-one communication line, the in-vehicle network or the like. Thereby, the ECU 11 can detect (derive) the speed of the vehicle 10, based on the wheel speed information about the vehicle 10.

The navigation device 16, using voice and displaying, performs a route proposition or route guide to a destination that is set by a user (specifically, a driver or a passenger) of the vehicle 10, or a destination that is automatically set. Here, examples of the destination that is automatically set include a destination that is predicted from a movement pattern based on a movement history of the user in the past. The destination that is automatically set may be a destination that is predicted by the navigation device 16, or may be a destination that is predicted by an external communicable navigation server or the like and that is downloaded through the DCM 13. The destination information retained in the navigation device 16 is taken in the ECU 11, through the in-vehicle network or the like.

Configuration of Center Server

Functions of the center server 20 may be realized by arbitrary hardware or a combination of hardware and software. As shown in FIG. 2B, for example, the center server 20 includes a drive device 21, an auxiliary storage device 22, a memory device 23, a CPU 24, an interface device 25, a display device 26, and an input device 27, which are connected with each other by a bus B2.

For example, programs for realizing various functions of the center server 20 are provided by a portable recording medium 21A such as a compact disc read only memory (CD-ROM), a digital versatile disc read only memory (DVD-ROM) or a universal serial bus (USB) memory. When the recording medium 21A in which the programs are recorded is set in the drive device 21, the programs are installed in the auxiliary storage device 22 from the recording medium 21A through the drive device 21. The programs may be downloaded from another computer through a communication network, and may be installed in the auxiliary storage device 22.

The auxiliary storage device 22 holds the installed programs, and holds necessary files, necessary data and the like.

When an activation instruction for a program is given, the memory device 23 reads the program from the auxiliary storage device 22, and holds the program.

The CPU 24 executes various programs held in the memory device 23, and realizes various functions about the center server 20 in accordance with the programs.

The interface device 25 is used as an interface for connection with a communication network (for example, the communication network NW).

For example, the display device 26 displays a graphical user interface (GUI) in accordance with a program that is executed by the CPU 24.

The input device 27 is used when an operator or administrator of the center server 20 inputs various operation instructions relevant to the center server 20.

Specific Behavior of Traffic State Information Collection System

Next, a specific behavior of the traffic state information collection system 1 according to the embodiment will be described with reference to FIG. 3 and FIG. 4.

Figure 3:
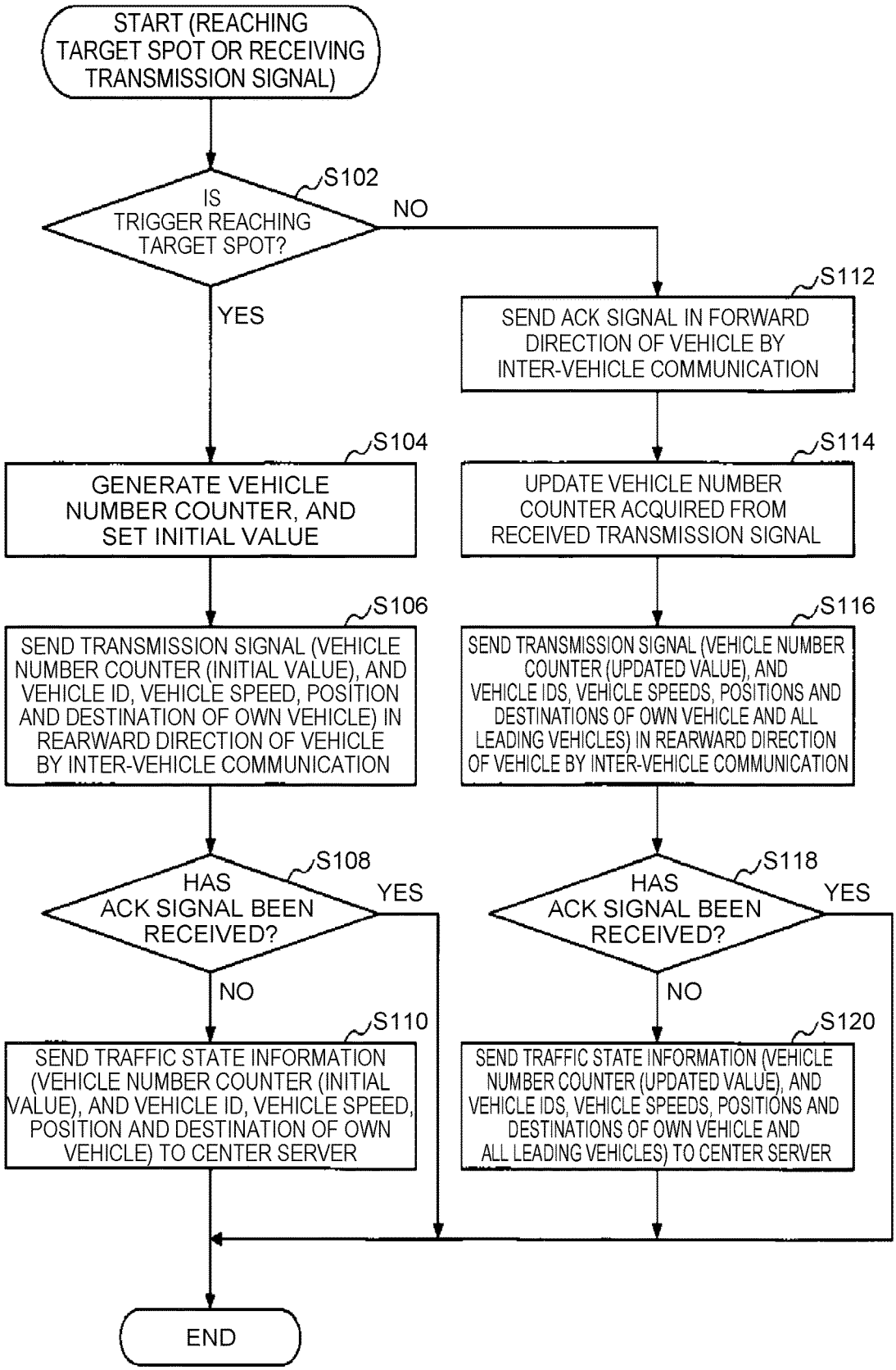
FIG. 3 is a flowchart schematically showing an exemplary process by an ECU.

FIG. 3 is a flowchart showing an exemplary process by the ECU 11 of the vehicle 10. FIG. 4 is a diagram for describing an operation of the traffic state information collection system 1.

As shown in FIG. 3, the process in the flowchart is started, when the vehicle 10 reaches the target spot (an exemplary predetermined position) or when the vehicle 10 receives a later-described transmission signal through the inter-vehicle communication module 14 from the different vehicle 10 that leads the vehicle 10 forward of the vehicle 10. On this occasion, for example, the ECU 11 can determine whether the vehicle 10 has reached the target spot, based on list information about the target spot that is previously delivered from the center server 20 and that is held in the auxiliary storage device 11A or the like and the position information about the vehicle 10 that is taken through the GNSS module 12.

In step S102, the ECU 11 (an exemplary control unit) determines whether the start of the flowchart is triggered by reaching the target spot. In the case where the start of the flowchart is triggered by reaching the target spot, the ECU 11 proceeds to step S104, and in the other case, that is, in the case where the start of the flowchart is triggered by receiving the transmission signal, the ECU 11 proceeds to step S112.

In step S104, the ECU 11 generates a vehicle number counter as the vehicle number information about the vehicle group including the vehicle 10, and sets the vehicle number counter to a predetermined initial value. The initial value may be an arbitrary value, and for example, the initial value is "1".

In step S106, the ECU 11 controls the inter-vehicle communication module 14, and sends the transmission signal including the vehicle number counter set to the initial value, from the directional antenna 14*a*, in the rearward direction of the vehicle 10. Specifically, the transmission signal includes identification information (for example, a vehicle identifier (ID) specific to one of the plurality of vehicles 10; hereinafter, referred to as "vehicle identification information") about the vehicle 10, the vehicle speed information, the position information and the destination information, in addition to the vehicle number counter.

In step S108, the ECU 11 controls the inter-vehicle communication module 14, such that only the electric wave from the rearward side of the vehicle 10 can be received, and waits to receive an acknowledgement (ACK) signal (an exemplary answer signal) from the different vehicle 10 positioned rearward of the vehicle 10. Then, the ECU 11 determines whether the ACK signal has been received in a predetermined wait time. In the case where the ACK signal has not been received, the ECU 11 determines that there is no different vehicle 10 that follows the vehicle 10 at a relatively short inter-vehicle distance rearward of the vehicle 10, and proceeds to step S110. In the case where the ACK signal has been received, the ECU 11 determines that there is the different vehicle 10 that follows the vehicle 10 at a relatively short inter-vehicle distance rearward of the vehicle 10, and ends this process.

In step S110, the ECU 11 sends, to the center server 20, the traffic state information including the vehicle number counter set to the initial value and the vehicle identification information, vehicle speed information, position information and destination information of the vehicle 10, and ends this process.

Meanwhile, in step S112, the ECU 11 controls the inter-vehicle communication module 14, and sends the ACK signal from the directional antenna 14*a* in the forward direction of the vehicle 10.

In step S114, the ECU 11 updates the value of the vehicle number counter acquired from the transmission signal received from the different vehicle 10 that leads the vehicle 10 forward of the vehicle 10, to a new value resulting from incrementing (increasing) the value of the vehicle number counter by a predetermined value. The predetermined value may be an arbitrary value, and for example, the predetermined value is "1". The ECU 11 may update the value of the vehicle number counter, by decrementing (decreasing) the value of the vehicle number counter by a predetermined value.

In step S116, the ECU 11 controls the inter-vehicle communication module 14, and sends the transmission signal including the vehicle number counter updated to the new value, from the directional antenna 14*a*, in the rearward direction of the vehicle 10. Specifically, the transmission signal includes the vehicle identification information, vehicle speed information, position information and destination information about the vehicle 10, in addition to the vehicle number counter. Further, the transmission signal includes the vehicle identification information, vehicle speed information, position information, destination information and others about all different vehicles 10 that are positioned forward of the vehicle 10. The information about all different vehicles 10 is included in the transmission signal received from the different vehicle 10 that leads the vehicle 10 forward of the vehicle 10. Here, "all different vehicles 10 that are positioned forward of the vehicle 10" means all different vehicles 10 from the first different vehicle 10 that is the source of the transmission signal, that is, the different vehicle 10 that sends the transmission signal in the rearward direction when reaching the target spot, to the different vehicle 10 that is adjacent to the vehicle 10 forward of the vehicle 10.

In step S118, the ECU 11 waits to receive the ACK signal from the different vehicle 10 positioned rearward of the vehicle 10, and determines whether the ACK signal has been received in the predetermined wait time, similarly to step S108. In the case where the ACK signal has been received, the ECU 11 determines that there is no different vehicle 10 that follows the vehicle 10 at a relatively short inter-vehicle distance rearward of the vehicle 10, and proceeds to step S120. In the case where the ACK signal has been received, the ECU 11 determines that there is the different vehicle 10 that follows the vehicle 10 at a relatively short inter-vehicle distance rearward of the vehicle 10, and ends this process.

In step S120, the ECU 11 sends, to the center server 20, the traffic state information including the vehicle number counter updated to the new value and the vehicle identification information, vehicle speed information, position information and destination information about the vehicle 10 and all different vehicles 10 that are positioned forward of the vehicle 10, and ends this process.

Figure 4:
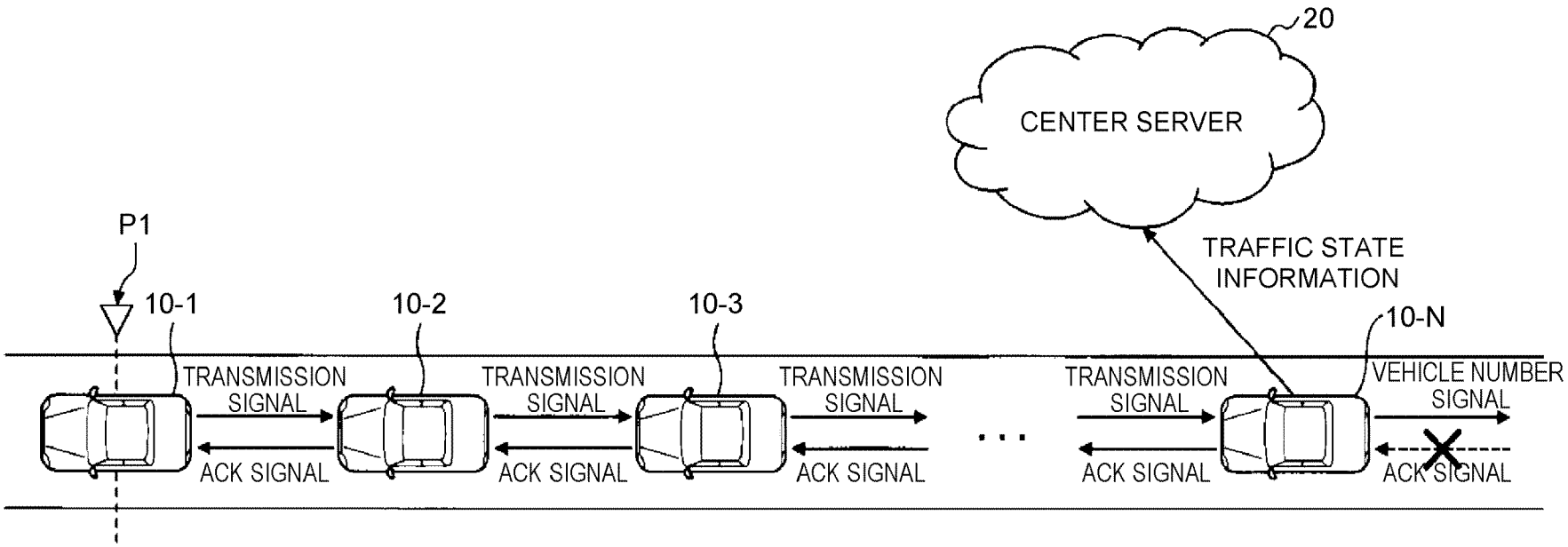
FIG. 4 is a diagram for describing an operation of the traffic state information collection system.

The behavior of the traffic state information collection system 1 based on the flowchart of FIG. 3 will be described, for example, using a vehicle group constituted by N (in this example, a positive integer of 4 or more) vehicles 10 that travels at relatively short inter-vehicle distances as shown in FIG. 4. In this example, the N vehicles 10 of the vehicle group are numbered as vehicles 10-1, 10-2, 10-3, . . . , 10-N, in the order from the head vehicle.

When reaching a target spot P1, the head vehicle 10-1 of the vehicle group sends the transmission signal including the vehicle number counter set to the initial value and the like, from the directional antenna 14*a* of the inter-vehicle communication module 14, in the rearward direction (step S110 in FIG. 3).

The following vehicle 10-2 of the vehicle group receives the transmission signal from the vehicle 10-1 that leads the vehicle 10-2 at a relatively short inter-vehicle distance, through the inter-vehicle communication module 14, and sends the ACK signal in the forward direction of the vehicle 10-2 (step S112 in FIG. 3). The ACK signal is received by the inter-vehicle communication module 14 of the vehicle 10-1. Thereby, the leading vehicle 10-1 recognizes the existence of the following vehicle 10-2 (Yes in step S108). Then, the following vehicle 10-2 of the vehicle group sends the transmission signal including the vehicle number counter updated to a new value and the like, from the directional antenna 14*a* of the inter-vehicle communication module 14, in the rearward direction (step S116 in FIG. 3).

The following vehicle 10-3 of the vehicle group receives the transmission signal from the vehicle 10-2 that leads the vehicle 10-3 at a relatively short inter-vehicle distance, through the inter-vehicle communication module 14, and sends the ACK signal in the forward direction of the vehicle 10-3 (step S112 in FIG. 3). The ACK signal is received by the inter-vehicle communication module 14 of the vehicle 10-2. Thereby, the vehicle 10-2 recognizes the existence of the following vehicle 10-3 (Yes in step S118). Then, the following vehicle 10-3 of the vehicle group sends the transmission signal including the vehicle number counter updated to a new value and the like, from the directional antenna 14*a* of the inter-vehicle communication module 14, in the rearward direction (step S116 in FIG. 3).

In this way, the transmission signal including the vehicle number counter and the like is transmitted, while the vehicle number counter is updated from the head vehicle 10-1 to the last vehicle 10-N and the vehicle identification information, vehicle speed information, position information, destination information and others about the vehicle 10 constituting the vehicle group is added.

The last vehicle 10-N of the vehicle group receives the transmission signal from the vehicle 10-M (M=N−1) that leads the vehicle 10-N at a relatively short inter-vehicle distance, through the inter-vehicle communication module 14, and sends the ACK signal in the forward direction of the vehicle 10-N (step S112 in FIG. 3). The ACK signal is received by the inter-vehicle communication module 14 of the vehicle 10-M. Thereby, the vehicle 10-M recognizes the existence of the following vehicle 10-N (Yes in step S118). Then, the last vehicle 10-N of the vehicle group sends the transmission signal including the vehicle number counter updated to a new value and the like, from the directional antenna 14*a* of the inter-vehicle communication module 14, in the rearward direction (step S116 in FIG. 3). On this occasion, since there is no vehicle 10 that follows the vehicle 10-N at a relatively short inter-vehicle distance rearward of the vehicle 10-N, the inter-vehicle communication module 14 of the vehicle 10-N does not receive the ACK signal (No in step S118 in FIG. 3). Therefore, the last vehicle 10-N of the vehicle group determines that there is no vehicle 10 that follows the vehicle 10-N at a relatively short inter-vehicle distance, and sends, to the center server 20, the traffic state information including the vehicle number counter updated to the new value and the vehicle identification information, vehicle speed information, position information and destination information about the vehicle 10-N and all different vehicles 10 that are positioned forward of the vehicle 10-N, that is, the vehicles 10-1 to 10-M (step S120 in FIG. 3).

The center server 20 grasps the traffic volume at the target spot, based on the vehicle number counter corresponding to the number of the vehicles of the vehicle group that travels through the target spot at relatively short inter-vehicle distances. Then, the center server 20 may determine the situation of the occurrence of the congestion (for example, whether the congestion occurs, and the degree of the congestion), based on the traffic volume at the target spot, the vehicle speed information about each vehicle 10 that passes through the target spot, the capacity of the road, and the like. Further, the center server 20 may determine the position of the tail end of the congestion, using the position information about the last vehicle 10 of the vehicle group.

Further, the center server 20 may predict future traffic states such as the situation of the occurrence of the congestion, based on vehicle number counters for vehicle groups that pass through a plurality of target spots, and the like. On this occasion, the center server 20 can predict future traffic states such as the situation of the occurrence of the congestion, in consideration of the destination information about the vehicles 10 of the vehicle groups that pass through the target spots.

In the flowchart of FIG. 3, not only the head vehicle 10-1 of the vehicle group but also the following vehicles 10-2 to 10-N of the vehicle group, when reaching the target spot P1, send the transmission signal set to the initial value, from the directional antenna 14*a* of the corresponding inter-vehicle communication module 14, in the rearward direction (step S106 in FIG. 3). Therefore, for example, in a situation where the congestion gets lighter and the number of the vehicles of the vehicle group decreases as the vehicle group moves forward, or in a situation where the congestion conversely gets heavier and the number of the vehicles of the vehicle group increases as the vehicle group moves forward, the traffic state information reflecting the situation is sequentially sent from the last vehicle 10 to the center server 20. Accordingly, the center server 20 can grasp change in the traffic state at the target spot.

Operation of Embodiment

Next, an operation of the traffic state information collection system 1 (the ECU 11 of the vehicle 10) according to the embodiment will be described.

In the embodiment, the ECU 11 controls the inter-vehicle communication module 14 capable of communicating with the following vehicle that is positioned at equal to or shorter than the predetermined first distance (the communicable distance) rearward of the vehicle 10 (the own vehicle) and the leading vehicle that is positioned at equal to or shorter than the predetermined second distance (the communicable distance) forward of the vehicle 10. When the vehicle 10 passes through the target spot, the ECU 11 sends the transmission signal including the vehicle number counter set to a predetermined initial value, from the inter-vehicle communication module 14, in the rearward direction of the vehicle 10. When the ECU 11 receives the transmission signal including the vehicle number counter through the inter-vehicle communication module 14 from the different vehicle 10 that leads the vehicle 10 forward of the vehicle 10, the ECU 11 sets the vehicle number counter included in the transmission signal, to a new value resulting from increasing or decreasing the vehicle number counter by the predetermined value, and sends the transmission signal including the vehicle number counter set to the new value, from the inter-vehicle communication module 14, in the rearward direction of the vehicle 10. When the vehicle 10 passes through the target spot and the ECU 11 determines that there is no different vehicle 10 that follows the vehicle 10 at a relatively short inter-vehicle distance rearward of the vehicle 10, the ECU 11 sends the vehicle number counter set to the initial value, to the center server 20. When the ECU 11 receives the transmission signal including the vehicle number counter through the inter-vehicle communication module 14 from the different vehicle 10 that leads the vehicle 10 forward of the vehicle 10 and the ECU 11 determines that there is no different vehicle 10 that follows the vehicle 10 at a relatively short inter-vehicle distance rearward of the vehicle 10, the ECU 11 sends the vehicle number counter set to the new value, to the center server 20.

Thereby, when the head vehicle of a certain vehicle group passes through the target spot, the ECU 11 of the head vehicle can send the transmission signal including the vehicle number counter set to the initial value, to the different vehicle 10 that follows the head vehicle. Further, by setting the first distance (the communicable distance) and the second distance (the communicable distance) to relatively short distances, in response to the transmission signal sent from the head vehicle 10, the ECU 11 of the following vehicle 10 that is performing follow-up traveling at a relatively short inter-vehicle distance can transmit the transmission signal including the vehicle number counter, to the last different vehicle 10, while updating the vehicle number counter. Then, the ECU 11 of the last following vehicle 10 determines that there is no different vehicle 10 that follows at a relatively short inter-vehicle distance, and thereby, can send the vehicle number counter corresponding to the number of the vehicles of the vehicle group, to the center server 20. Further, when the vehicle 10 of the vehicle group that is traveling at relatively long inter-vehicle distances or the vehicle 10 that is performing solo traveling passes through the target spot, the ECU 11 of the vehicle 10 determines that there is no different vehicle 10 that follows the vehicle 10 at a relatively short inter-vehicle distance, and thereby, can send the vehicle number counter with the initial value indicating that the vehicle 10 is a vehicle of a vehicle group that is traveling at a relatively long inter-vehicle distance or that the vehicle 10 is performing the solo traveling, to the center server 20. Therefore, the center server 20 can grasp how many vehicles pass through the target spot so as to be lined at relatively short inter-vehicle distances, based on the vehicle number counter sent from the ECU 11. On this occasion, for example, even when the vehicle group is temporarily divided into two small vehicle groups so that the center server 20 receives two vehicle number counters for the leading vehicle group and the following vehicle group, the center server 20 can regard the two vehicle groups as a single vehicle group, by comparing the receiving timings, and can determine the occurrence of the congestion. Accordingly, the ECU 11 allows the center server 20 to more appropriately determine the occurrence of the congestion. Further, the transmission signal is sent only at the target spot, and therefore, unlike the above-described JP 2003-272095 A, for example, the ECU 11 does not need to check the situation of the communication with the following different vehicle 10 while constantly sending a signal in the rearward direction of the own vehicle. Accordingly, the ECU 11 can restrain electric power consumption by the inter-vehicle communication module 14, and as a result, can restrain fuel consumption by the vehicle 10.

In the embodiment, when the ECU 11 receives the transmission signal including the vehicle number counter through the inter-vehicle communication module 14 from the different vehicle 10 that leads the vehicle 10 forward of the vehicle 10, the ECU 11 may send the ACK signal indicating that the ECU 11 has received the transmission signal, from the inter-vehicle communication module 14, in the forward direction of the vehicle 10, and when the ECU 11 sends the transmission signal including the vehicle number counter set to the initial value or the new value from the inter-vehicle communication module 14 in the rearward direction of the vehicle 10 and the ECU 11 does not receive the ACK signal from the different vehicle 10 that follows the vehicle 10 rearward of the vehicle 10, the ECU 11 may determine that there is no different vehicle 10 that follows the vehicle 10 at a relative short inter-vehicle distance rearward of the vehicle 10.

Thereby, the ECU 11, specifically, can determine that there is no different vehicle 10 that follows the vehicle 10 at a relatively short inter-vehicle distance, in the case where the ECU 11 sends the transmission signal including the vehicle number counter in the rearward direction of the own vehicle but no following different vehicle 10 sends back the ACK signal.

The ECU 11 may determine that there is no vehicle that follows the own vehicle at a relatively short inter-vehicle distance rearward of the own vehicle, by another method. For example, the ECU 11 may determine that there is no vehicle 10 that follows the own vehicle at a relatively short inter-vehicle distance rearward of the own vehicle, based on detection information of a pickup device that is mounted on the vehicle 10 and that picks up a rearward view, and a physical body detector that detects a physical body positioned rearward of the vehicle 10, as exemplified by a millimeter wave radar and a LIDAR (Light Detection And Ranging). In this case, the ECU 11 may previously determine whether there is a vehicle 10 that follows the own vehicle at a relatively short inter-vehicle distance rearward of the own vehicle, and when there is no vehicle, the ECU 11 may send the traffic state information to the center server 20, without sending the transmission signal from the directional antenna 14*a* of the inter-vehicle communication module 14 in the rearward direction.

In the embodiment, when the vehicle 10 passes the target spot, the ECU 11 may send the transmission signal including the vehicle number counter set to the initial value and the vehicle speed information about the vehicle 10, from the inter-vehicle communication module 14, in the rearward direction of the vehicle 10. When the ECU 11 receives the transmission signal including the vehicle number counter and the vehicle speed information about all of one or a plurality of different vehicles 10 that is lined forward of the vehicle 10 and that includes the different vehicle 10 that leads the vehicle 10 forward of the vehicle 10, from the different vehicle 10 that leads the vehicle 10, through the inter-vehicle communication module 14, the ECU 11 may set the vehicle number counter included in the transmission signal, to the new value, and may send the transmission signal including the vehicle number counter set to the new value and the vehicle speed information about the vehicle 10 and all different vehicles 10 positioned forward of the vehicle 10, from the inter-vehicle communication module 14, in the rearward direction of the vehicle 10. When the vehicle 10 passes through the target spot and the ECU 11 determines that there is no different vehicle 10 that follows the vehicle 10 at a relatively short inter-vehicle distance rearward of the vehicle 10, the ECU 11 may send the vehicle number counter set to the initial value and the vehicle speed information about the vehicle 10, to the center server 20. When the ECU 11 receives the transmission signal including the vehicle number counter and the vehicle speed information about all different vehicles 10 positioned forward of the vehicle 10 through the inter-vehicle communication module 14 from the different vehicle 10 that leads the vehicle 10 forward of the vehicle 10 and the ECU 11 determines that there is no different vehicle 10 that follows the vehicle 10 at a relatively short inter-vehicle distance rearward of the vehicle 10, the ECU 11 may send the vehicle number counter set to the new value and the vehicle speed information about the vehicle 10 and all different vehicles 10 positioned forward of the vehicle 10, to the center server 20.

Thereby, together with the vehicle number counter, the ECU 11 of the last following vehicle 10 of the vehicle group can send the vehicle speed information about the vehicles 10 constituting the vehicle group, that is, the vehicle speed information about the own vehicle and all different vehicles 10 positioned forward of the own vehicle, to the center server 20. The same goes for the ECU 11 of the vehicle 10 of the vehicle group that is traveling at relatively short inter-vehicle distances or the vehicle 10 that is performing the solo traveling. Accordingly, in consideration of the vehicle speed information about the vehicles 10 that pass the target spot, the center server 20 can more appropriately determine the situation of the occurrence of the congestion, and the like.

In the embodiment, when the vehicle 10 passes the target spot, the ECU 11 may send the transmission signal including the vehicle number counter set to the initial value and the destination information about the vehicle 10, from the inter-vehicle communication module 14, in the rearward direction of the vehicle 10. When the ECU 11 receives the transmission signal including the vehicle number counter and the destination information about all of one or a plurality of different vehicles 10 that is lined forward of the vehicle 10 and that includes the different vehicle 10 that leads the vehicle 10 forward of the vehicle 10, from the different vehicle 10 that leads the vehicle 10, through the inter-vehicle communication module 14, the ECU 11 may set the vehicle number counter included in the transmission signal, to the new value, and may send the transmission signal including the vehicle number counter set to the new value and the destination information about the vehicle 10 and all different vehicles 10 positioned forward of the vehicle 10, from the inter-vehicle communication module 14, in the rearward direction of the vehicle 10. When the vehicle 10 passes through the target spot and the ECU 11 determines that there is no different vehicle 10 that follows the vehicle 10 at a relatively short inter-vehicle distance rearward of the vehicle 10, the ECU 11 may send the vehicle number counter set to the initial value and the destination information about the vehicle 10, to the center server 20. When the ECU 11 receives the transmission signal including the vehicle number counter and the destination information about all different vehicles 10 positioned forward of the vehicle 10 through the inter-vehicle communication module 14 from the different vehicle 10 that leads the vehicle 10 forward of the vehicle 10 and the ECU 11 determines that there is no different vehicle 10 that follows the vehicle 10 at a relatively short inter-vehicle distance rearward of the vehicle 10, the ECU 11 may send the vehicle number counter set to the new value and the destination information about the vehicle 10 and all different vehicles 10 positioned forward of the vehicle 10, to the center server 20.

Thereby, together with the vehicle number counter, the ECU 11 of the last following vehicle 10 of the vehicle group can send the destination information about the vehicles 10 constituting the vehicle group, that is, the destination information about the own vehicle and all different vehicles 10 positioned forward of the own vehicle, to the center server 20. The same goes for the ECU 11 of the vehicle 10 of the vehicle group that is traveling at relatively short inter-vehicle distances or the vehicle 10 that is performing the solo traveling. Accordingly, for example, from the destination information about the vehicles 10 that pass through the target spot, the center server 20 can predict future traffic states at other predetermined positions.

The embodiment of the disclosure has been described above in detail. The disclosure is not limited to the particular embodiment, and various modifications and improvements can be made in the scope of the spirit of the disclosure described in the claims.

What is claimed is:

1. A vehicle control device that is mounted on a vehicle, the vehicle control device being configured to communicate with a predetermined external device, the vehicle control device comprising:

a control unit that controls a first communication unit and a second communication unit, the first communication unit being configured to communicate with a following vehicle that is positioned at equal to or shorter than a predetermined first distance rearward of the vehicle, the second communication unit being configured to communicate with a leading vehicle that is positioned at equal to or shorter than a predetermined second distance forward of the vehicle, wherein:

in response to a determination that the vehicle passes through a predetermined position, the control unit sends a signal from the first communication unit in a rearward direction of the vehicle, the signal including vehicle number information set to a predetermined initial value, in response to a determination that the control unit receives the signal including the vehicle number information through the second communication unit from the leading vehicle that is positioned forward of the vehicle, the control unit sets the vehicle number information included in the signal, to a new value resulting from increasing or decreasing the vehicle number information by a predetermined value, and sends a signal from the first communication unit in the rearward direction of the vehicle, the signal including the vehicle number information set to the new value, in response to a determination that the vehicle passes through the predetermined position and the control unit determines that there is no following vehicle that is positioned at a relatively short inter-vehicle distance rearward of the vehicle, the control unit sends the vehicle number information set to the initial value, to the external device, in response to a determination that the control unit receives the signal including the vehicle number information through the second communication unit from the leading vehicle that is positioned forward of the vehicle and the control unit determines that there is no following vehicle that is positioned at the relatively short inter-vehicle distance rearward of the vehicle, the control unit sends the vehicle number information set to the new value, to the external device, and the external device is not another vehicle.

2. The vehicle control device according to claim 1, wherein:

in response to a determination that the control unit receives the signal including the vehicle number information through the second communication unit from the leading vehicle that is positioned forward of the vehicle, the control unit sends an answer signal from the second communication unit in a forward direction of the vehicle, the answer signal indicating that the control unit has received the signal including the vehicle number information, and in response to a determination that the control unit sends the signal including the vehicle number information set to the initial value or the new value from the first communication unit in the rearward direction of the vehicle and the control unit does not receive the answer signal from the following vehicle that is positioned rearward of the vehicle, the control unit determines that there is no following vehicle that is positioned at the relatively short inter-vehicle distance rearward of the vehicle.

3. The vehicle control device according to claim 1, wherein:

in response to a determination that the vehicle passes through the predetermined position, the control unit sends a signal from the first communication unit in the rearward direction of the vehicle, the signal including the vehicle number information set to the initial value and vehicle speed information about the vehicle, in response to a determination that the control unit receives a signal through the second communication unit from the leading vehicle that is positioned forward of the vehicle, the signal including the vehicle number information and vehicle speed information about one or a plurality of different vehicles that is lined forward of the vehicle and that includes the leading vehicle, the control unit sets the vehicle number information included in the signal, to the new value, and sends a signal from the first communication unit in the rearward direction of the vehicle, the signal including the vehicle number information set to the new value and vehicle speed information about the vehicle and the different vehicles, in response to a determination that the vehicle passes through the predetermined position and the control unit determines that there is no following vehicle that is positioned at the relatively short inter-vehicle distance rearward of the vehicle, the control unit sends the vehicle number information set to the initial value and the vehicle speed information about the vehicle, to the external device, and in response to a determination that the control unit receives the signal including the vehicle number information and the vehicle speed information about the different vehicles through the second communication unit from the leading vehicle that is positioned forward of the vehicle and the control unit determines that there is no following vehicle that is positioned at the relatively short inter-vehicle distance rearward of the vehicle, the control unit sends the vehicle number information set to the new value and the vehicle speed information about the vehicle and the different vehicles, to the external device.

4. The vehicle control device according to claim 1, wherein:

in response to a determination that the vehicle passes through the predetermined position, the control unit sends a signal from the first communication unit in the rearward direction of the vehicle, the signal including the vehicle number information set to the initial value and destination information about the vehicle, in response to a determination that the control unit receives a signal through the second communication unit from the leading vehicle that is positioned forward of the vehicle, the signal including the vehicle number information and destination information about one or a plurality of different vehicles that is lined forward of the vehicle and that includes the leading vehicle, the control unit sets the vehicle number information included in the signal, to the new value, and sends a signal from the first communication unit in the rearward direction of the vehicle, the signal including the vehicle number information set to the new value and destination information about the vehicle and the different vehicles, in response to a determination that the vehicle passes through the predetermined position and the control unit determines that there is no following vehicle that is positioned at the relatively short inter-vehicle distance rearward of the vehicle, the control unit sends the vehicle number information set to the initial value and the destination information about the vehicle, to the external device, and in response to a determination that the control unit receives the signal including the vehicle number information and the destination information about the different vehicles through the second communication unit from the leading vehicle that is positioned forward of the vehicle and the control unit determines that there is no following vehicle that is positioned at the relatively short inter-vehicle distance rearward of the vehicle, the control unit sends the vehicle number information set to the new value and the destination information about the vehicle and the different vehicles, to the external device.

5. A vehicle control method that is executed by a vehicle control device, the vehicle control device being mounted on a vehicle, the vehicle control device being configured to communicate with a predetermined external device, the vehicle control method comprising:

a control step of controlling a first communication unit and a second communication unit, the first communication unit being configured to communicate with a following vehicle that is positioned at equal to or shorter than a predetermined first distance rearward of the vehicle, the second communication unit being configured to communicate with a leading vehicle that is positioned at equal to or shorter than a predetermined second distance forward of the vehicle, wherein:

in the control step, in response to a determination that the vehicle passes through a predetermined position, the vehicle control device sends a signal from the first communication unit in a rearward direction of the vehicle, the signal including vehicle number information set to a predetermined initial value, in the control step, in response to a determination that the vehicle control device receives the signal including the vehicle number information through the second communication unit from the leading vehicle that is positioned forward of the vehicle, the vehicle control device sets the vehicle number information included in the signal, to a new value resulting from increasing or decreasing the vehicle number information by a predetermined value, and sends a signal from the first communication unit in the rearward direction of the vehicle, the signal including the vehicle number information set to the new value, in the control step, in response to a determination that the vehicle passes through the predetermined position and the vehicle control device determines that there is no following vehicle that is positioned at a relatively short inter-vehicle distance rearward of the vehicle, the vehicle control device sends the vehicle number information set to the initial value, to the external device, in response to a determination that the vehicle control device receives the signal including the vehicle number information through the second communication unit from the leading vehicle that is positioned forward of the vehicle and the vehicle control device determines that there is no following vehicle that is positioned at the relatively short inter-vehicle distance rearward of the vehicle, the vehicle control device sends the vehicle number information set to the new value, to the external device, and the external device is not another vehicle.

6. A non-transitory computer readable medium having instructions stored therein, which when executed by a processer in a vehicle control device mounted on a vehicle and being configured to communicate with a predetermined external device, causes the vehicle to execute a vehicle control method comprising:

a control step of controlling a first communication unit and a second communication unit, the first communication unit being configured to communicate with a following vehicle that is positioned at equal to or shorter than a predetermined first distance rearward of the vehicle, the second communication unit being configured to communicate with a leading vehicle that is positioned at equal to or shorter than a predetermined second distance forward of the vehicle, wherein:

in the control step, in response to a determination that the vehicle passes through a predetermined position, the vehicle control device sends a signal from the first communication unit in a rearward direction of the vehicle, the signal including vehicle number information set to a predetermined initial value, in the control step, in response to a determination that the vehicle control device receives the signal including the vehicle number information through the second communication unit from the leading vehicle that is positioned forward of the vehicle, the vehicle control device sets the vehicle number information included in the signal, to a new value resulting from increasing or decreasing the vehicle number information by a predetermined value, and sends a signal from the first communication unit in the rearward direction of the vehicle, the signal including the vehicle number information set to the new value, in the control step, in response to a determination that the vehicle passes through the predetermined position and the vehicle control device determines that there is no following vehicle that is positioned at a relatively short inter-vehicle distance rearward of the vehicle, the vehicle control device sends the vehicle number information set to the initial value, to the external device, in response to a determination that the vehicle control device receives the signal including the vehicle number information through the second communication unit from the leading vehicle that is positioned forward of the vehicle and the vehicle control device determines that there is no following vehicle that is positioned at the relatively short inter-vehicle distance rearward of the vehicle, the vehicle control device sends the vehicle number information set to the new value, to the external device, and the external device is not another vehicle.

7. The vehicle control device of claim 1, wherein the external device is a server.

8. The vehicle control device of claim 1, wherein the vehicle number information indicates a number of vehicles traveling in a group of vehicles including the vehicle in which the vehicle control device is mounted.

* * * * *